US007347463B2

(12) United States Patent
Blight

(10) Patent No.: US 7,347,463 B2
(45) Date of Patent: Mar. 25, 2008

(54) CONCEALED DOOR FURNITURE FIXING METHOD AND ASSEMBLY

(75) Inventor: Brian Blight, Bentleigh East (AU)

(73) Assignee: Assa Abloy Australia Pty Limited, Oakleigh (AU)

( * ) Notice: Subject to any disclaimer, the term of this patent is extended or adjusted under 35 U.S.C. 154(b) by 125 days.

(21) Appl. No.: 10/508,361

(22) PCT Filed: Mar. 5, 2003

(86) PCT No.: PCT/AU03/00267

§ 371 (c)(1),
(2), (4) Date: Sep. 17, 2004

(87) PCT Pub. No.: WO03/080968

PCT Pub. Date: Oct. 2, 2003

(65) Prior Publication Data

US 2005/0167997 A1 Aug. 4, 2005

(30) Foreign Application Priority Data

Mar. 25, 2002 (AU) ..... PS1356

(51) Int. Cl.
*E05B 15/02* (2006.01)

(52) U.S. Cl. ..... 292/357; 292/337

(58) Field of Classification Search ..... 292/336.3, 292/337, DIG. 53, DIG. 64
See application file for complete search history.

(56) References Cited

U.S. PATENT DOCUMENTS

| | | | | | |
|---|---|---|---|---|---|
| 1,907,128 | A | * | 5/1933 | Steele | 16/412 |
| 3,107,113 | A | * | 10/1963 | Sconzo | 292/228 |
| 4,296,619 | A | | 10/1981 | Widen | |
| 4,699,409 | A | * | 10/1987 | Newman | 292/357 |
| 4,732,418 | A | * | 3/1988 | Crown et al. | 292/207 |
| 5,762,387 | A | * | 6/1998 | Edgerly et al. | 292/357 |

FOREIGN PATENT DOCUMENTS

AU 49040/85 5/1986

* cited by examiner

*Primary Examiner*—Gary Estremsky
(74) *Attorney, Agent, or Firm*—Renner, Otto, Boisselle & Sklar, LLP

(57) ABSTRACT

A furniture plate assembly extends over a mortise lock in a door and contains a pair of side plates extending over each side of the door, the side plates being clamped against the door by internal fasteners, the internal fasteners comprising a threaded stud which can be rotated by an adjustment member which can be operated from the edge of the door. The adjustment member can be provided with a clutch to prevent over tightening of the assembly. The threaded internal fastener provides better adjustment of the assembly than a cam type clamping device.

12 Claims, 8 Drawing Sheets

CONCEALED DOOR FURNITURE FIXING METHOD AND ASSEMBLY

FIELD OF THE INVENTION

This invention is directed to an assembly and a method for the attachment of furniture plates and the like to doors. Such plates are used, by way of example, for the attachment of devices such as knobs, handles and locks to doors. However, the plates can also be used for decorative purposes, or to provide a hard anti scratch or anti scuff plates around knobs, handles and the like.

BACKGROUND ART

Furniture plates are usually metal rectangular plate members which are attached to each side of a door and in the area where the lock/handle is attached to the door. The plates typically have a thickness of between 1-30 mm, a length of typically between 5-20 cm, and a width of typically between 3-10 cm. The plates are usually screwed in position by either wood screws or metal thread screws. Metal thread screws are generally preferred because in most cases they provide a more secure form of attachment. The plates can improve the security of the door lock by making it more difficult to punch a hole through the door to access or to vandalise the lock components.

If a high degree of security is required, there is an advantage in being able to attach the furniture plates in a concealed manner which means that the attachment screws are not visible or cannot be manipulated by an intruder. A concealed attachment can also provide an aesthetic arrangement to the door.

It is known to provide a concealed screw system involving the use of screws which are accessed through an edge rather than the front face of the furniture plate. While this provides a level of deterrent to an intruder, the arrangement is not entirely satisfactory in practice because the screw heads are still accessible to a degree sufficient to permit intrusion. The system is not entirely satisfactory for aesthetic reasons because of the need for recesses in the plate edge to receive the screw heads.

It is known to provide a concealed fastening arrangement which includes at least one tension member secured to an inside surface of the furniture plate and which extends substantially at right angles from the inside surface of the furniture plate, the tension member being located within the body of the door, and a camming member located in the door body and which engages with the tension member to pull the tension members together thereby pulling the furniture plates against the door side surfaces. A camming arrangement has disadvantages including the lack of fine adjustment and the need to have precisely machined and positioned components to ensure proper engagement of the cams.

OBJECT OF THE INVENTION

The present invention is directed to a method and an assembly for concealing door furniture and which uses a thread arrangement instead of a cam arrangement to pull the furniture plates against the door side surface.

It is an object of the invention to provide a method and an assembly which may at least partially overcome the above-mentioned disadvantages or provide the consumer with the useful or commercial choice.

In one form, the invention resides in a furniture plate assembly which comprises at least one side plate attachable to the side of a door, an elongate member extending from an inside surface of the at least one side plate and which is attached to or attachable to the side plate, a threaded portion on the elongate member, an adjustment member which engages with the threaded portion on the elongate member, and means to adjust the adjustment member from a position external of the door, whereby adjustment of the adjustment member causes the elongate member to move which in turn can tighten the side plate against the door.

In this manner, the furniture plates can be clamped against the door without requiring external screws and without requiring a camming arrangement.

The furniture plate assembly can extend over an existing mortice lock which means that the existing internal lock components do not need modification.

The side plate typically comprises a substantially rectangular side plate. Suitably, a pair of side plates is provided one for each side of the door. Each side plate may be substantially flat but it is preferred that the side plates comprises an outer wall, and a peripheral sidewall to allow the side plates to extend somewhat proud of the door. The peripheral sidewall may have a width of between 5-30 mm. The plates may be made of metal, plastic, or any other suitable material.

A front plate may be provided which extends over the edge of the door. Typically, the front plate comprises a flat rectangular plate of metal, plastic or other suitable material. The front plate may replace the front plate which is normally found on the lock, or may comprise a modified front plate which is normally found on the lock. Typically however the lock front plate is removed and the front plate as described above is substituted. This front plate may have one or more openings which are typically found in a lock front plate and these openings may include a large opening through which the lock tongue can protrude, smaller openings for a secondary lock tongue, a button and the like, openings to fasten the front plate to the edge of the door, and the like. Suitably, the front plate contains at least one additional opening which allows the adjustment member to be adjusted from a position external of the door. This will be described in greater detail below. It should be appreciated that the furniture assembly can be used for other types of locks or latches.

The assembly may include a cover plate. The cover plate may be designed to extend over the front plate. The cover plate may contain an opening through which the lock tongue can protrude. The cover plate may further contain one or more openings to accommodate fasteners to fasten the cover plate relative to the door. Preferably, the cover plate covers the at least one additional opening in the front plate which means that manipulation of the adjustment member is prevented.

An elongate member is provided which extends from the side plate. The elongate member is attached to or attachable to the inside of the side plate. The elongate member may be formed integrally with the side plate. Alternatively, the elongate member is attached to the inside of the side plate. The inside of the side plate may be provided with attachment means to allow the elongate member to be attached relative to the side plate. The attachment means may comprise a threaded bore to threadingly engage to an end of the elongate member. Other types of attachments of the elongate member to the side plate are envisaged. These may include a press fit arrangement where the attachment means comprises a bore and the elongate member has an end portion which press fit into the bore; a twist lock arrangement which may include a bayonet type mounting, and the like.

Suitably, the elongate member comprises a stud, pin or rod. The stud may be solid or hollow. The stud is typically made of metal. The elongate member may have a length of between 5-30 mm depending on the thickness of the door. In a preferred embodiment, the elongate member comprises a threaded stud. One end of the threaded stud can threadingly attach into an attachment means of the side plate to attach the elongate member to the side plate. If desired, a stop member can form part of the elongate member to prevent the elongate member from passing too far into the attachment means.

Suitably, a plurality of elongate members is provided on each side plate. Typically, a first elongate member is positioned adjacent an upper part of the side plate and a second elongate member is positioned adjacent the lower part of the side plate.

The assembly includes an adjustment member. The adjustment member can have a threaded bore which engages with a threaded portion on the elongate member. The elongate member suitably comprises a continuously threaded stud, but may also comprise a threaded portion and an unthreaded portion. The adjustment member may comprise a tubular member with the internal passageway being at least partially threaded. Alternatively, the adjustment member may be open at only one end, or may be open at both ends but the internal passageway may not be continuous and may extend only partially through the adjustment member. Typically, the adjustment member comprises an elongate nut. An adjustment member may be provided in respect of each elongate portion. It is envisaged that the elongate portion on one side plate and the elongate portion on the other side plate may be operated by a single adjustment member. Adjustment of the elongate member can be achieved by rotation of the adjustment member which will cause the elongate member to pass further into or pass further out of the threaded bore.

The assembly includes a means to adjust the adjustment member and which can be done externally of the door. The means may comprise an elongate shaft member. The elongate shaft member may comprise a drive screw. The elongate shaft member may have a length of between 10-100 mm. One end of the elongate shaft member is typically accessible externally of the door. This end may be provided with a socket or other type of arrangement to allow a driver (such as a screwdriver, a phillips head screwdriver or an alien key, etc) to manipulate the elongate shaft member. Suitably, the elongate shaft member is rotatable about its longitudinal axis. Rotation of the elongate shaft member can cause rotation of the adjustment member. Suitably, the adjustment member is rotated by an intermediate member which may comprise a face gear. The face gear can be rotated by the elongate shaft member.

Suitably, a cap or a plug or other type of covering member or means is attached to the one end of the elongate shaft member to prevent the shaft member from being manipulated by the driver. This can provide improved security to the assembly and prevents the shaft member from undesirable turning due to vibration or the like.

Suitably, the elongate member is a stud having one threaded end portion and an opposite end which is unthreaded. The unthreaded end can be supported in a sleeve nut which can engage with a side plate. In this manner the studs are not rigid or unmovable but instead are able to adopt some movement (typically a rocking or pivoting movement) to facilitate assembly.

The assembly may be provided with a means to prevent over tightening of the assembly. The means may comprise a "clutch" type mechanism. This mechanism may be on or part of the shaft member. The shaft member may comprise a first part containing a socket or other type of arrangement to allow a driver (such as a screwdriver, a phillips head screwdriver or an alien key, etc) to manipulate the elongate shaft member, and a second part which can be rotated by the first part until a predetermined force if applied after which further rotation of the first part does not rotate the second part. The second part can be attached to a third part which can engage with the intermediate member.

BRIEF DESCRIPTION OF THE DRAWINGS

An embodiment of the invention will be described with reference to the following figures in which.

BEST MODE

Figure 1:
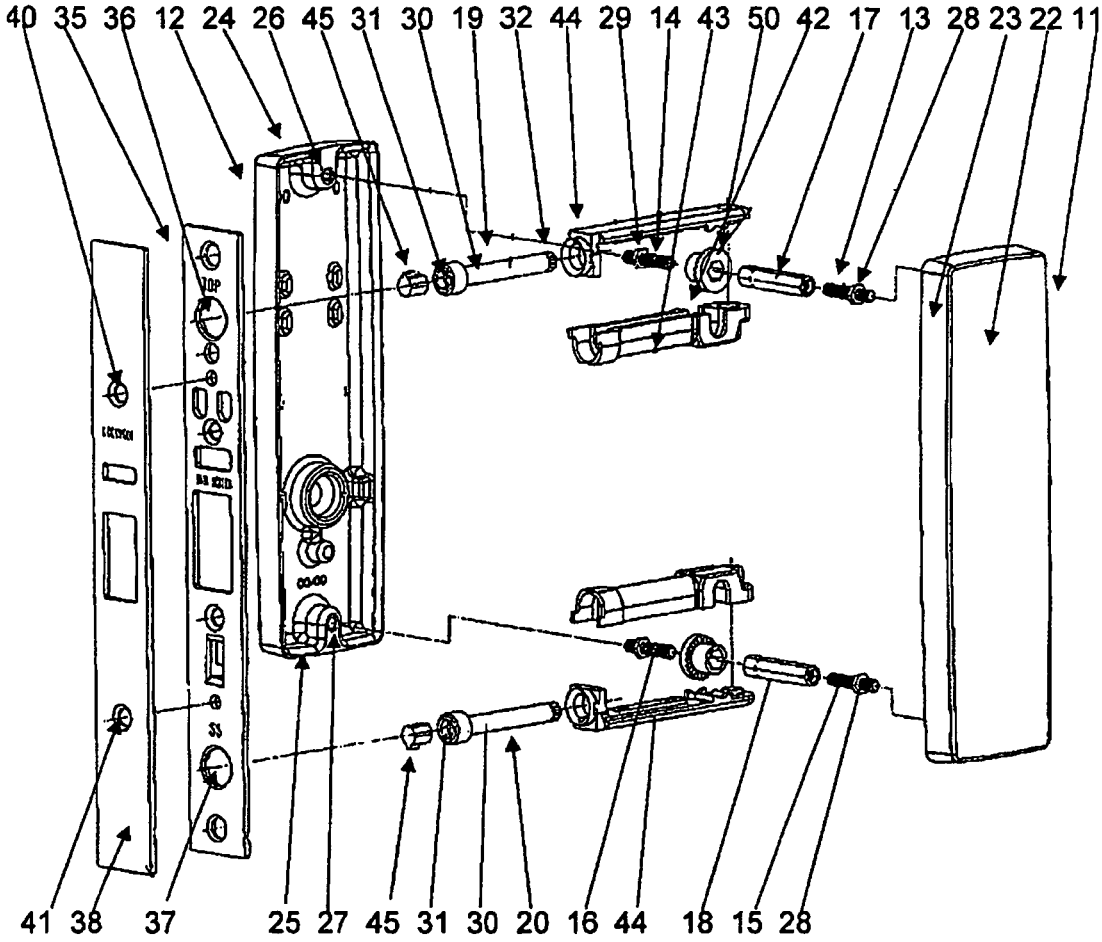
FIG. 1. Illustrates an exploded view of the assembly according to an embodiment of the invention.
Figure 2:
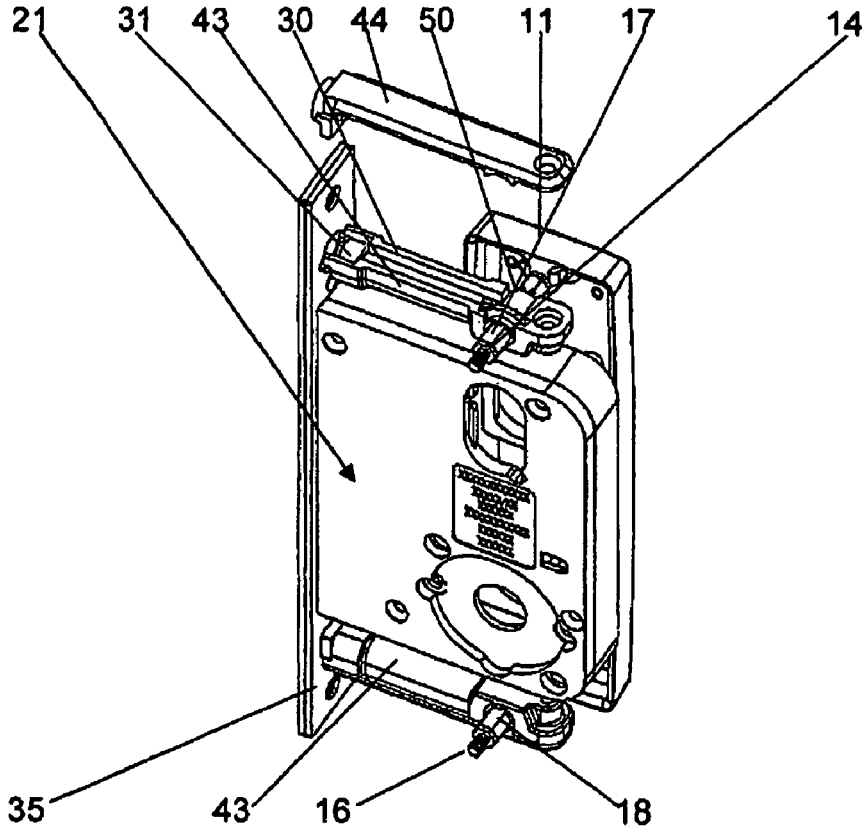
FIGS. 2-6. Illustrates various views of the assembly attached about a mortice lock.
Figure 3:
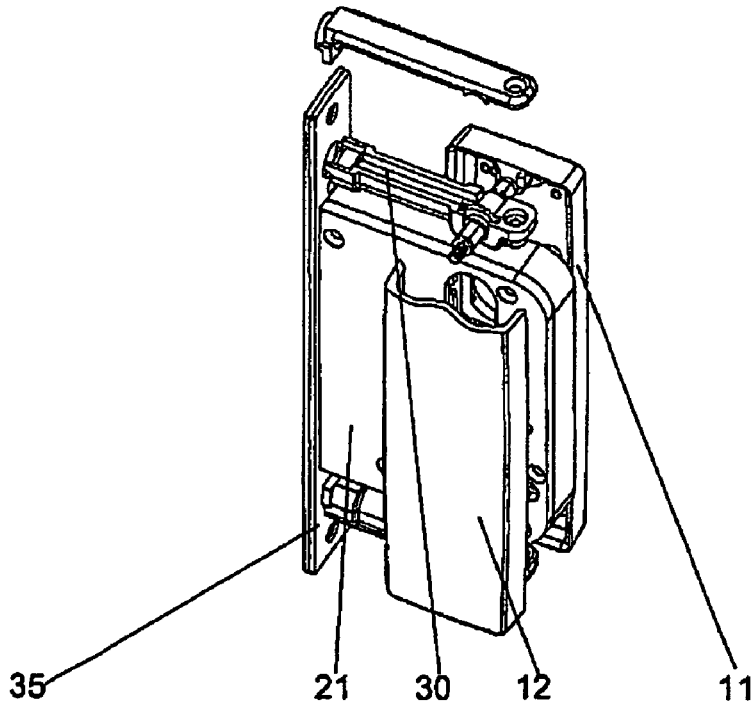
Figure 4:
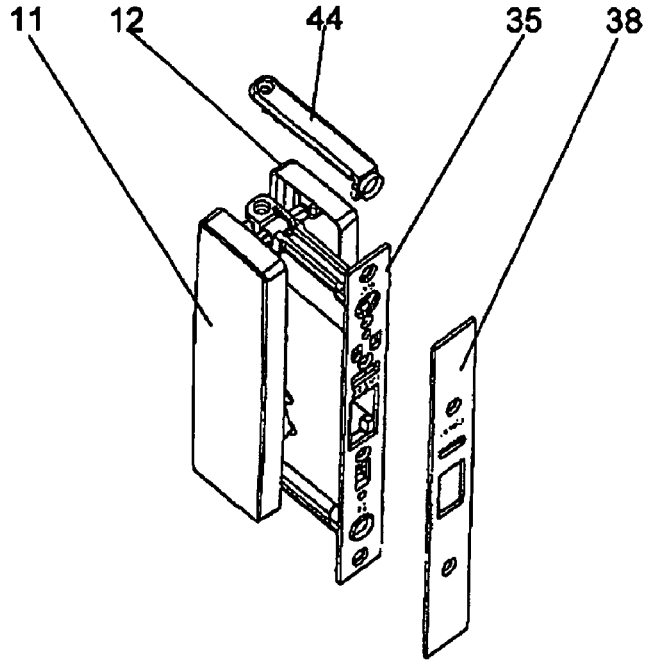
Figure 5:
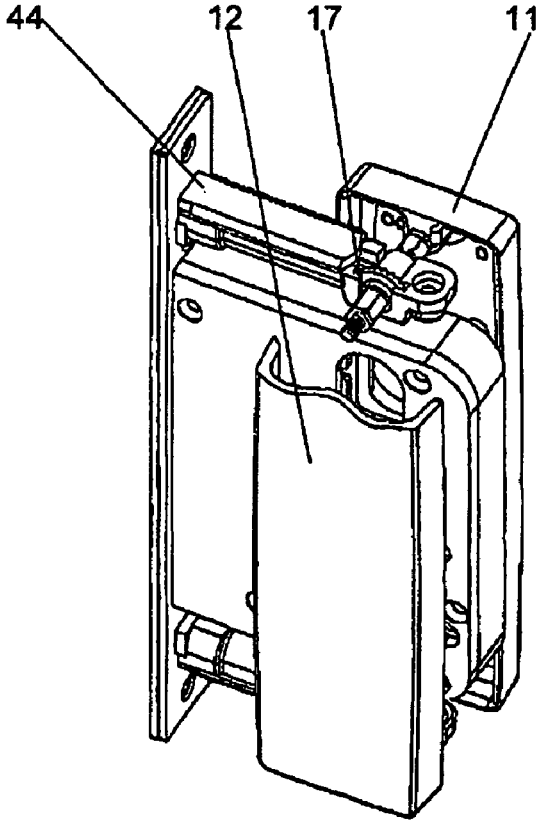
Figure 6:
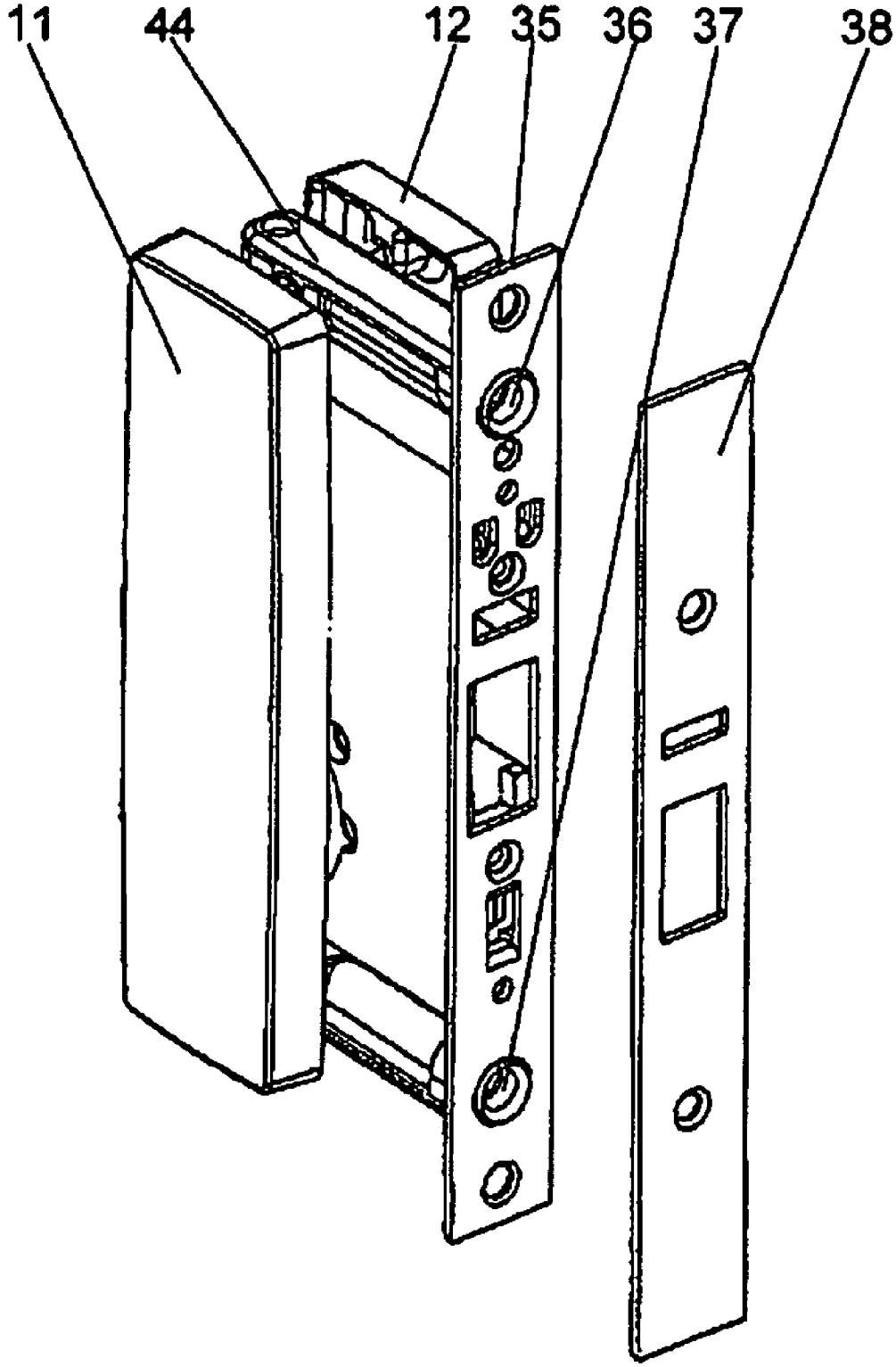
Figure 7:
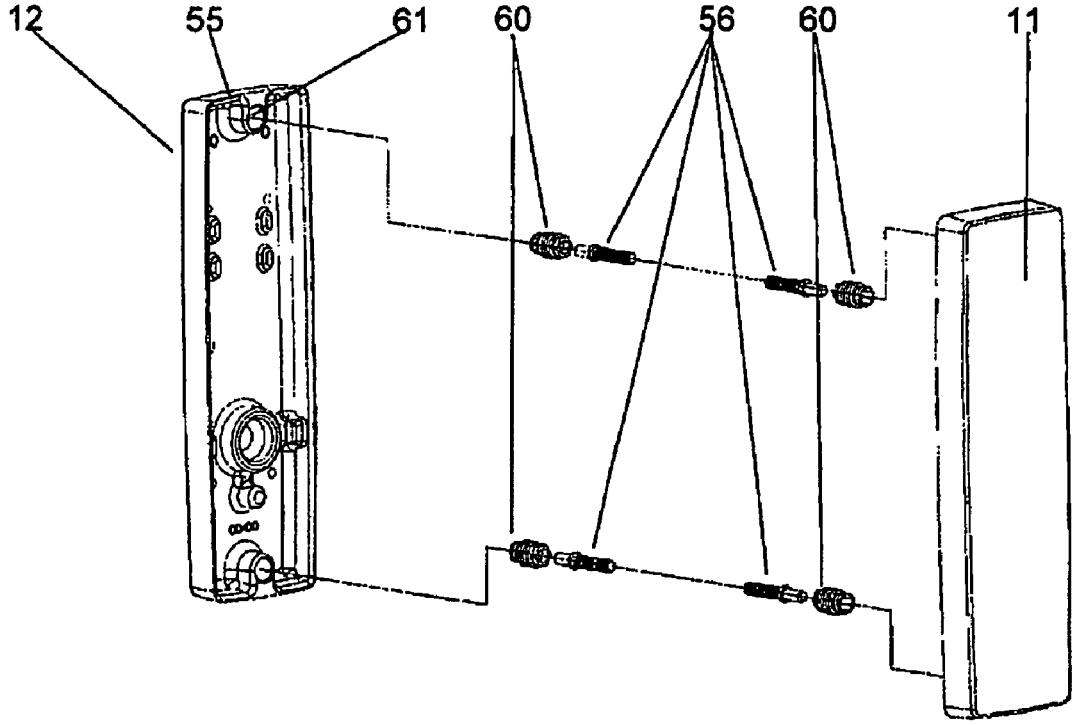
FIG. 7. Illustrates a second embodiment of the invention and particularly illustrates the studs fitted into sleeve nuts.
Figures 8, 9, 10:
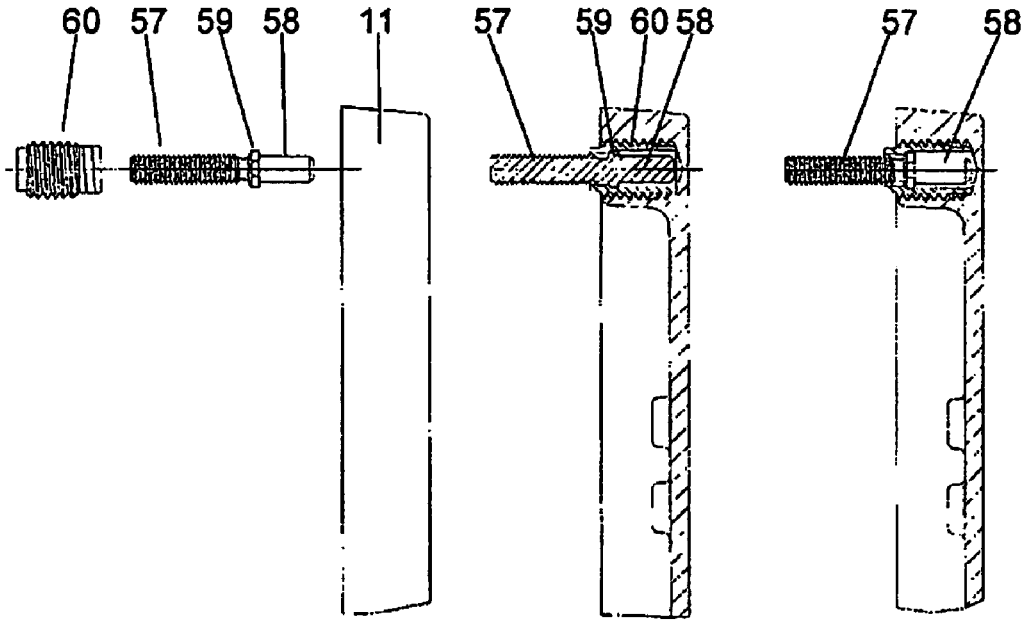
FIGS. 8-10. Illustrate the sleeve nuts in greater detail.

Referring to the embodiment and initially to FIG. 1, there is illustrated the various components of the assembly in an exploded view. Briefly, the components comprise a pair of side plates 11, 12 two pairs of elongate members in the form of threaded studs and which comprise an upper pair of elongate members 13, 14, and a lower pair of elongate members 15, 16, a pair of adjustment members in the form of floating nuts and comprising an upper adjustment member 17 and a lower adjustment member 18, and a pair of means to adjust the adjustment member and which comprise as one component an upper means 19 and a lower means 20.

Referring to the assembly in greater detail, the assembly extends about a conventional lock 21 (see FIGS. 2-6). Each side plate 11, 12 is rectangular in configuration and contains an outer wall 22 and a peripheral sidewall 23 such that the side plates extend proud of the door. The side plates may be provided with openings through which the lock handle can pass if desired.

On the inside of each plate is an upper attachment means 24, and a lower attachment means 25. These are formed integrally with the side plate and comprise a thickened portion formed with an elongate bore 26, 27 which does not pass entirely through the side plates and therefore each bore is a "blind bore". Each bore is provided with an internal thread.

Each elongate member 13-16 comprises a threaded stud. Each threaded stud has a length of between 5-30 mm and is made of metal. One end of each stud (e.g. 14, 16) threadingly engages into a respective bore (e.g. 26, 27). A stop member in the form of a small nut 28, 29 is attached to each stud and functions to prevent the threaded stud from being inserted too far into a respective bore 26, 27 or to prevent the threaded stud from damaging the side plate. Of course, the studs can be attached to the side plates by other means.

Each adjustment member 17, 18 comprises a floating nut in the form of an elongate tubular hollow member having an internal threaded bore and an external wall which is polygonal (typically hexagonal) in shape. The floating nut has a length of between 10-40 mm. Each pair of threaded studs (ie 13, 14) threadingly engages into the floating nut. The threaded bore in the floating nut has a right-handed internal thread at one end and a left-handed internal thread at the other end. Therefore, rotation of the floating nut in one direction will cause the threaded studs to both move into the floating nut while rotation of the floating nut in the other direction will cause the threaded studs to both move out of the floating nut. This, in turn, will loosen or tighten the side plates relative to the door. Of course, it is also possible for the threaded studs to have a left-handed thread and a right-handed thread.

Floating nut 17 is adjusted (by being rotated) by means 19. Means 19 comprises an elongate shaft in the form of a drive screw 30. Drive screw 30 has a socket 31 adjacent one end, and this end can be manipulated from outside the door by a driver (typically an alien key). Drive screw 30 engages an intermediate member which is in the form of a face gear 50. Face gear 50 has a hollow body which has a hexagonal configuration which allows floating nut 17 to slide in the body but rotation of face gear 50 will cause floating nut 17 to rotate. Face gear 50 is rotated by teeth 32 on the other end of drive screw 30.

The assembly of the embodiment includes a front plate 35. Front plate 35 comprises a flat plate member formed with openings through which various lock components can pass (for instance, these components can include the lock tongue etc). Importantly, each plate 35 includes an upper larger opening 36 and a lower larger opening 37. These openings allow socket 31 of the drive screw 30 to be manipulated by an appropriate tool.

A cover plate 38 sits over front plate 37. The cover plate has an opening for the lock tongue, but importantly, the cover plate covers the openings 36, 37 in each plate 35. This improves the security of the assembly. Cover plate 38 includes two small fastening openings 40, 41 through which fasteners can pass to fasten the cover plate to the door or lock.

Drive screw 30, face gear 50 and adjustment member 17 are supported in the assembly by a housing assembly 42. Housing assembly 42 comprises a gear housing 43, and a housing cover plate 44.

In use, an existing lock 21 is fitted to the door. If necessary, the existing lock front plate is replaced with front plate 35. The assembly is fitted around the existing lock 21 as illustrated in FIGS. 2-6. A driver fits inside socket 31 and is rotated to cause the adjustment member (floating nut) 17 to rotate which tightens each side plate 11, 12 against the door. When the side plates have been tightened, a small plastic plug 45 is pushed inside each socket 31 to provide additional security and prevents the drive screw from vibrating loose. The cover plate 38 is then screwed over front plate 35 which means that the drive screws 19, 20 are no longer available for manipulation. Nut 17 can slide back axially through face gear 50 which provides a self centering action as the mechanism is operated depending on which elongate member (e.g. in 13,14) is engaged first.

Referring to FIG. 7-10, these figures illustrate a variation of the invention which is directed to the studs. Specifically, this variation provides some adjustability to the studs. Referring to the figures, studs 56 have one end 57 which is threaded and an opposed end 58 which is smooth. A small collar 59 is provided intermediate the ends of the studs. A sleeve nut 60 is provided. The stud 56 passes through sleeve nut 60 by passing the threaded end 57 through the sleeve nut. Collar 59 prevents the stud 56 from passing entirely through the sleeve nut. Sleeve nut 60 has an external thread and is threaded into a threaded bore 61 in each side plate 12, 11. The arrangement results in the studs 56 no longer being rigid and being able to move and align better with the sleeve nut on assembly to the door. This is particularly so when one fixing point is screwed in considerably more than the other and the furniture plate starts to angle at the end that has not been screwed in as much.

Figure 11:
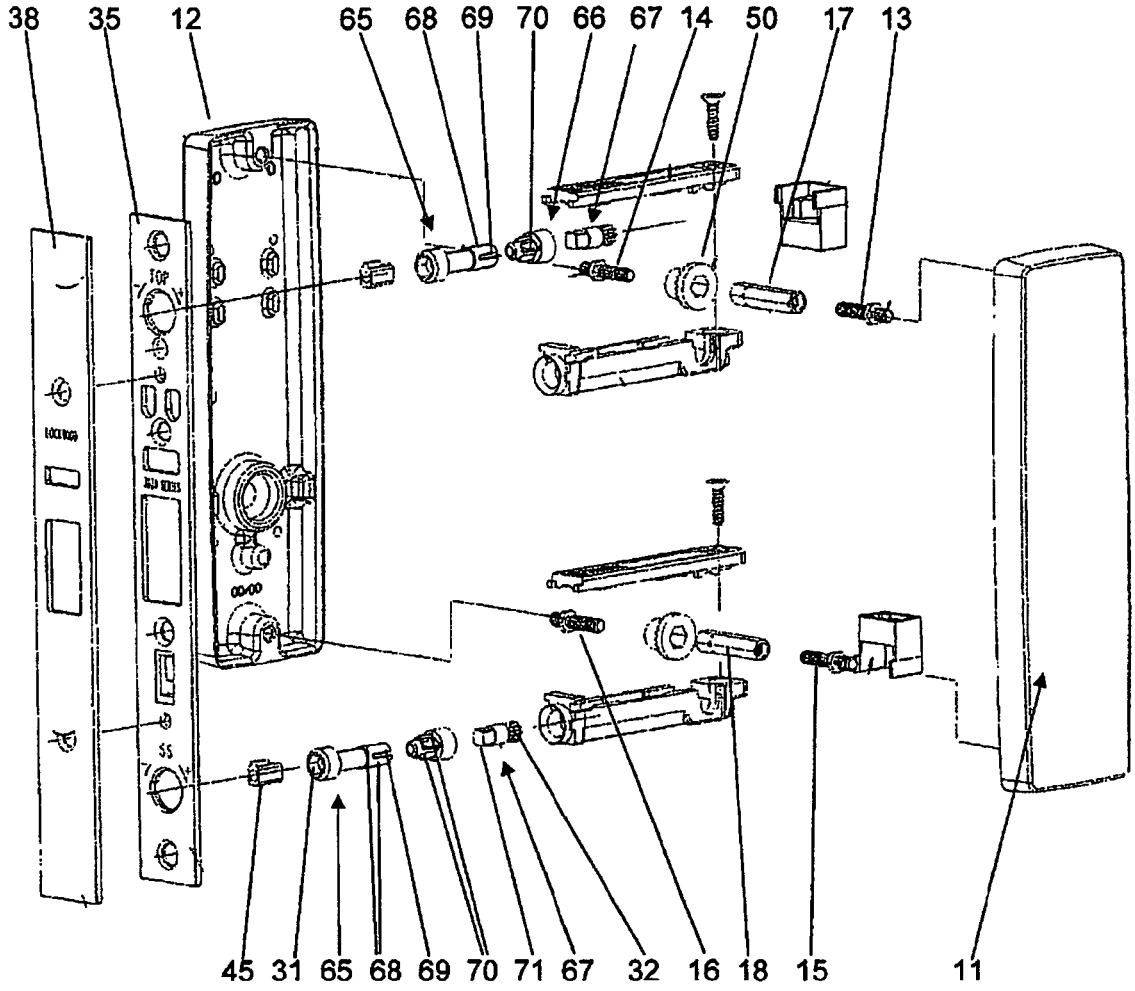
FIG. 11. Illustrates an embodiment of the invention containing a clutch mechanism to prevent over tightening of the assembly.

FIG. 11 illustrates a variation to the invention where the variation is directed to a clutch mechanism to prevent over tightening of the components. In this embodiment, the clutch mechanism is formed on the shaft member (drive screw) and basically the drive screw 30 in FIG. 1 has been replaced with the modified drive screw illustrated in FIG. 11. Specifically, the drive screw comprises a first part 65, a second part 66, and a third part 67. First part 65 has a socket 31 which is identical to that described in FIG. 1. A plug 45 can be pressed into socket 31 for the reasons given above. The other end of first part 65 is provided with a plurality of fingers 68. Fingers 68 are slightly spaced apart to form slots 69 between adjacent fingers. Second part 66 is provided with an array of shorts tabs 70 which pass into the slots 69. Thus, rotation of first part 65 will also cause rotation of second part 66 because of the engagement of tabs 70 between adjacent fingers 68. The other end of second part 66 is provided with a socket (not illustrated) which fits over stub 71 of third part 67. Thus, third part 67 is drivingly engaged to second part 66. The other end of third part 67 contains teeth 32 in a manner similar to the teeth 32 illustrated on the shaft member in FIG. 1. In use, the three-part assembly (65-67) can be rotated by inserting and turning a tool in socket 31. The teeth 32 will engage with face gear 50 in the manner described above. When the entire apparatus is clamped together, further rotation by the tool will cause first part 65 to ride over tabs 70 in the second part 66 such that second part 66 no longer rotates. Specifically, fingers 68 will deform and disengage with tabs 70. This deformation is facilitated by making first part 65 and second part 66 from plastics/spring steel or any other suitable material. The tabs 70 on second part 66 are not symmetrical but instead have one curved edge and an opposed edge which is straight. Thus, rotation of first part 65 in one direction will initially cause second part 66 to rotate but further rotation will cause fingers 68 to ride over tabs 70 as the fingers ride over the curved edge of each tab. However, rotation in the opposite direction results in the fingers contacting the straight edge and in this direction of rotation, there is no release of the fingers from the tab and thus there is no clutching. Thus, this arrangement can be seen as a one-way clutch arrangement.

Figure 12:
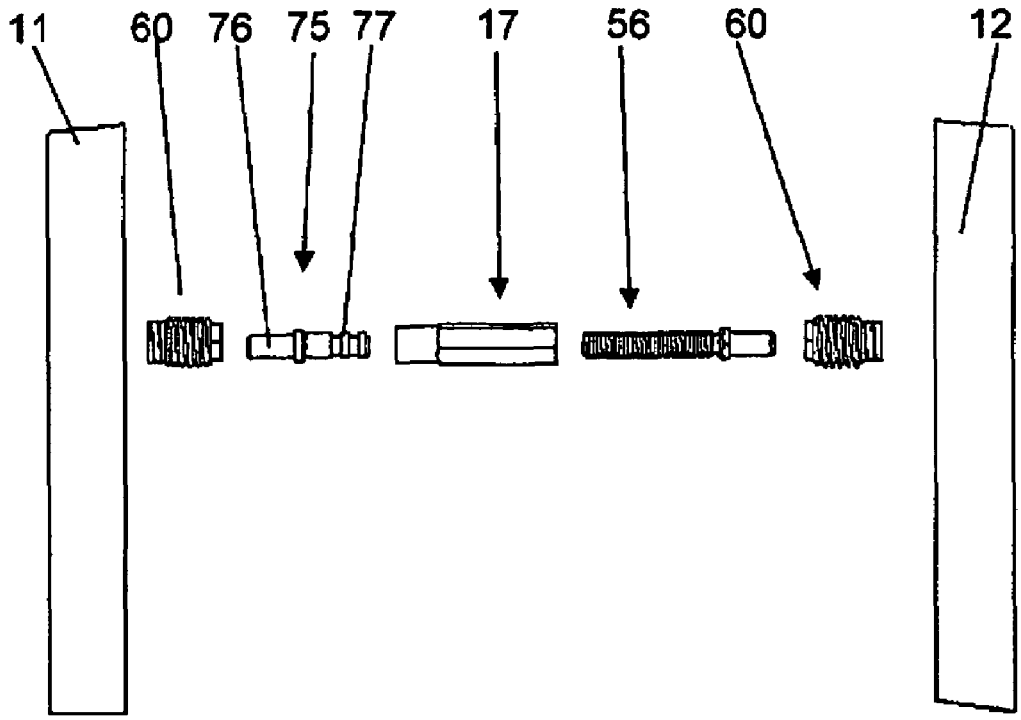
FIG. 12. Illustrates another version of the studs.

FIG. 12 illustrates a variation of the studs which is a variation to that described in FIG. 7-10. Specifically, stud 56 is unchanged and is captured within sleeve nut 60 in the manner described with reference to FIG. 7-10. However, the other stud 75 is completely or predominantly unthreaded. One end 76 is captured within sleeve nut 60 in the manner described above. However, the other end 77 is captured within elongate nut 17. Thus, stud 75 does not extend or retract relative to elongate nut 17 while stud 56 does. This variation therefore results in side plates 11, 12 being drawn together only by stud 56 being pulled in or pushed out of elongate nut 17. The other stud 75 can be seen as an "idle" stud.

Figure 13:
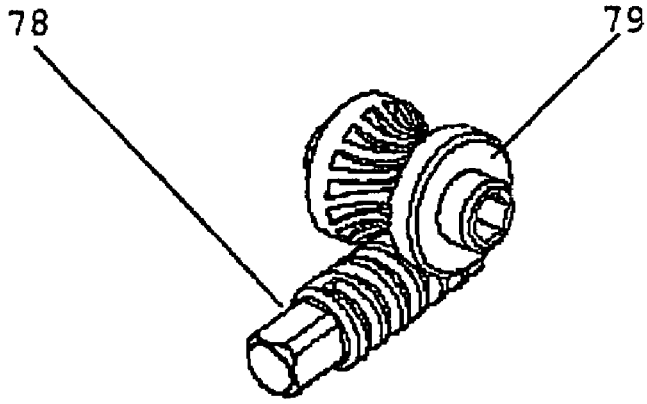
FIG. 13. Illustrates a variation to the operation of the studs.

FIG. 13 illustrates a variation in the operative attachment of the elongate shaft 19 relative to nut 17. Specifically, FIG.

13 illustrates a variation of the three-part arrangement 65, 66, 67 which is best illustrated in FIG. 11. In FIG. 11, the third part 67 is replaced with part 78 illustrated in FIG. 13. Face gear 50 is replaced with gear 79 as illustrated in FIG. 13. The variation illustrated in FIG. 13 can be seen as a worm drive and illustrates that the precise operative connection between the elongate shaft and nut 17 can vary.

Figure 14:
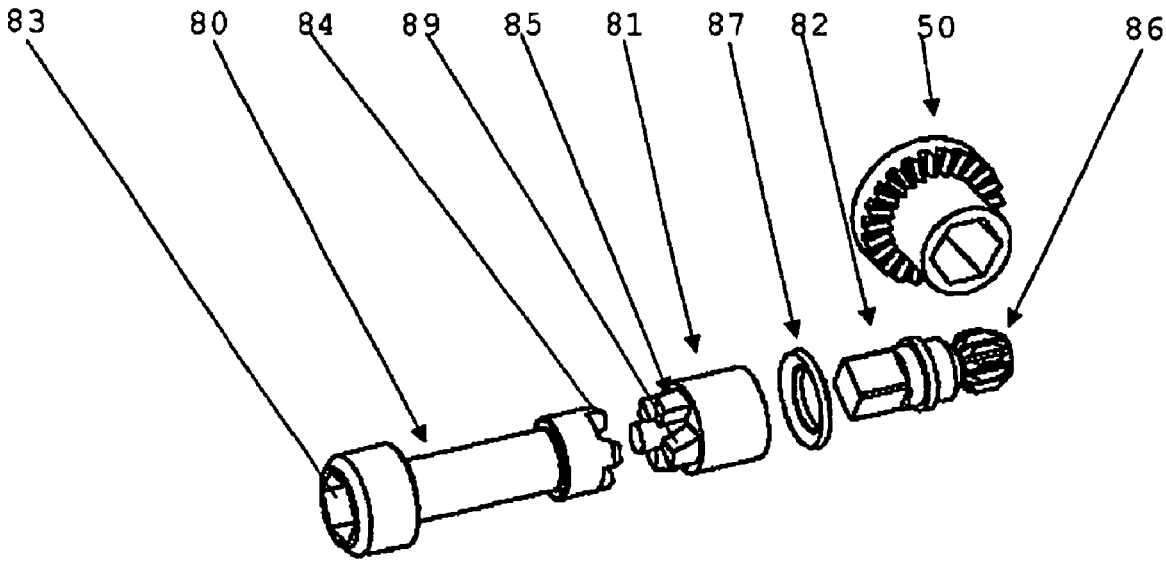
FIG. 14. Illustrates another type of clutch mechanism to prevent over tightening of the assembly.

FIG. 14 illustrates a variation to the clutch assembly which is illustrated generally in FIG. 11. The arrangement of FIG. 14 again comprises three main components 80, 81, 82. Component 80 has a socket 83 at one end to allow a small plastic plug to be pushed into the socket, and contains a number of short stubby projections 84 at the other end. Component 81 also contains a number of short stubby projections 85. Component 82 fits into the rear of component 81 in the manner similar to that described above. The other end of component 82 is formed with teeth 86 which mesh with the face gear 50. Component 81 is biased into engagement with projections 84 via a spring washer 87. Washer 87 sits on a collar 88 on third component 82 and presses component 81 into engagement with projections 84 on component 80. Specifically, projections 85 and projections 84 engage such that rotation of component 80 causes rotation of component 81. Projections 85 have one angled face 89 such that over rotation of component 80 causes projections 84 to ride over projections 85 and at the same time causes component 81 to be pushed back against the bias of spring 87. Thus, a clutching mechanism is provided. Rotation in the other direction does not provide the same type of clutching mechanism although if component 80 is rotated in the other direction with enough force, projections 84 will ride over projections 85 to cause a clutching action. However, the intention is that the clutching action is more pronounced when rotating component 80 in the direction which causes the furniture components to be clamped together and thereby preventing over tightening and damage to the mechanism.

It should be appreciated that various other changes and modifications can be made to the embodiment described without departing from the spirit and scope of the invention.

The invention claimed is:

1. A furniture plate assembly which comprises at least one side plate attachable to the side of a door, the door having a pair of opposed sides and a front edge, an elongate member extending from an inside surface of the at least one side plate and which is attached to or attachable to the side plate, a threaded portion on the elongate member, an adjustment member which engages with the threaded portion on the elongate member, and means to adjust the adjustment member from a position external of the door, the means for adjusting the adjustment member being operable through the front edge of the door, whereby adjustment of the adjustment member causes the elongate member to move which in turn can tighten the side plate against the door, wherein the adjustment member comprises an elongate nut.

2. The assembly as claimed in claim 1 wherein the means to adjust the elongate nut is an elongate shaft member one end of which is accessible from the edge of the door and the other end of which is operatively associated with the elongate nut.

3. The assembly as claimed in claim 2, containing a face gear which is operated by the elongate shaft member and which operates the elongate nut.

4. The assembly as claimed in claim 3, wherein the face gear contains a through passageway and extends over the elongate nut.

5. The assembly as claimed in claim 2, wherein the elongate shaft member comprises two separate parts being a first part and a second part, the first part having one end which is accessible from the edge of the door, and a second end which contains one part of a clutch mechanism, the second part having one end which contains the other part of a clutch mechanism and which is clutchingly engageable with the first part.

6. The assembly as claimed in claim 5, wherein the clutch mechanism on the first part comprises resilient fingers containing a spacing there between and the clutch mechanism on the second part comprises tab members which extend into the spacing.

7. The assembly as claimed in claim 6, wherein rotation of the first part in one direction causes the clutch mechanism to operate while rotation of the first part in the opposite direction does not result in operation of the clutch mechanism.

8. The assembly as claimed in claim 5, comprising a third part, the third part being drivingly engaged to the second part, the third part containing a plurality of teeth which engage with the face gear.

9. The assembly as claimed in claim 2, wherein the elongate shaft member is provided with a socket adjacent the end which is accessible from the edge of the door to allow a tool to be inserted into the socket.

10. The assembly as claimed in claim 9 comprising a plug which plugs into the socket to prevent the tool from being inserted into the socket.

11. A furniture plate assembly which comprises at least one side plate attachable to the side of a door, the door having a pair of opposed sides and a front edge, an elongate member extending from an inside surface of the at least one side plate and which is attached to or attachable to the side plate, a threaded portion on the elongate member, an adjustment member which engages with the threaded portion on the elongate member, and means to adjust the adjustment member from a position external of the door, the means for adjusting the adjustment member being operable through the front edge of the door, whereby adjustment of the adjustment member causes the elongate member to move which in turn can tighten the side plate against the door, wherein the elongate member comprises an elongate cylindrical stud having a pair of opposed ends, the stud being threaded along a portion of each end, the stud containing a collar intermediate the ends of the stud.

12. A furniture plate assembly which comprises at least one side plate attachable to the side of a door, the door having a pair of opposed sides and a front edge, an elongate member extending from an inside surface of the at least one side plate and which is attached to or attachable to the side plate, a threaded portion on the elongate member, an adjustment member which engages with the threaded portion on the elongate member, and means to adjust the adjustment member from a position external of the door, the means for adjusting the adjustment member being operable through the front edge of the door, whereby adjustment of the adjustment member causes the elongate member to move which in turn can tighten the side plate against the door, wherein the elongate member comprises an elongate cylindrical stud having a pair of opposed ends, the stud being threaded along a portion of one end, and being unthreaded at the other end, the assembly additionally containing a sleeve nut which extends over and which captures the unthreaded end of the stud, the sleeve nut being attachable to the side plate.

* * * * *